United States Patent [19]

Dantzig et al.

[11] Patent Number: 4,523,624

[45] Date of Patent: Jun. 18, 1985

[54] CAST INGOT POSITION CONTROL PROCESS AND APPARATUS

[75] Inventors: Jonathan A. Dantzig, Hamden; Peter E. Sevier; Gary L. Ungarean, both of Woodbridge, all of Conn.

[73] Assignee: International Telephone and Telegraph Corporation, New York, N.Y.

[21] Appl. No.: 313,885

[22] Filed: Oct. 22, 1981

[51] Int. Cl.[3] ..... B22D 11/16

[52] U.S. Cl. ..... 164/454; 164/413; 164/440; 164/484; 164/490

[58] Field of Search ..... 164/413, 454, 442, 484, 164/440, 490; 324/207, 208; 356/73.1; 250/561, 577

[56] References Cited

U.S. PATENT DOCUMENTS

| | | | |
|---|---|---|---|
| 3,565,155 | 2/1971 | Vertesi et al. | 164/478 |
| 3,608,614 | 9/1971 | Meier et al. | 164/413 |
| 3,614,978 | 10/1971 | Kosco | 164/413 |
| 3,633,010 | 1/1972 | Svetlichny | 164/413 |
| 4,161,206 | 7/1979 | Yarwood | 164/467 |
| 4,422,041 | 12/1983 | Lienau | 324/207 |

FOREIGN PATENT DOCUMENTS

| | | | |
|---|---|---|---|
| 915381 | 11/1972 | Canada | 164/413 |

*Primary Examiner*—Nicholas P. Godici
*Assistant Examiner*—Richard K. Seidel
*Attorney, Agent, or Firm*—James B. Raden; Harold J. Holt

[57] ABSTRACT

A process and apparatus for controlling the position of a cast ingot is provided so that unwanted distortions of the casting are substantially avoided. The instant process and apparatus also permit substantially uniform heat transfer about the casting periphery. A control system for maintaining the casting within a mold so that the casting outer periphery is substantially uniformly spaced from the mold inner wall comprises a casting supporting mechanism adjacent the mold exit and non-thermal position detectors.

9 Claims, 6 Drawing Figures

CAST INGOT POSITION CONTROL PROCESS AND APPARATUS

The invention herein is directed to an apparatus and process for controlling the position of an ingot within a mold during continuous or semi-continuous casting of a molten metal or metal alloy.

Many types of direct chill, continuous or semi-continuous, vertical and/or horizontal systems for casting metal or metal alloys are known in the prior art. Such casting systems are exemplified by those shown in U.S. Pat. Nos. 3,565,155 and 3,608,614 and Canadian Pat. No. 915,381. When using such a casting system, unwanted distortions to the shape of the ingot being cast frequently occur as a result of uneven heat transfer due to casting position within a mold, mold distortion and/or differential solidification shrinkage of the casting and, in horizontal casting systems, gravity. As a consequence of these unwanted distortions, the cast ingot may exit the mold at an angle to the casting axis or the ingot centerline may not be coincident with the mold centerline. This may lead to periodic angle changes, which are known as humping, when the ingot contacts the casting conveyance mechanisms. Furthermore, the cast ingot may have poor surface quality as a result of drag marks, longitudinal cracking of the surface and metal breakthrough. Excessive mold wear may also occur.

One approach used in the prior art to deal with these problems focuses on the maintenance of a substantially uniform cooling effect on the cast ingot. U.S. Pat. No. 3,608,614 to Meier et al. and Canadian Pat. No. 915,381 to Vertesi exemplify this type of approach. The Meier et al. patent discloses a casting system having a plurality of independent cooling chambers within a mold. The rate of heat transfer to each of the cooling chambers is measured. The heat transfer rates are then compared and a carrier member is operated as a result of the comparison to move a casting as it leaves the mold. By repositioning the exiting casting, the solidifying casting within the mold is repositioned to achieve the desired uniform cooling effect.

The Vertesi patent discloses a horizontal casting system and takes cognizance of the effect of gravity on the solidifying ingot during horizontal casting. During horizontal casting, gravity causes the solidifying casting or ingot to shrink away from the top of the mold to a greater extent than it shrinks away from the bottom of the mold. Different sized air gaps are created at the top and bottom of the mold which result in the creation of an uneven heat transfer effect. Vertesi suggests two different methods of dealing with this uneven heat transfer effect. The first method utilizes an unbalanced water cooling arrangement. An adjustable mold is located within a mold sleeve so as to provide a gap through which coolant flows between the two. The gap at the top is preferably smaller than the gap at the bottom. In this manner, as coolant flows through the top and bottom gaps, a higher coolant velocity is produced at the top than at the bottom. As a result, heat removal should be substantially uniform around the casting surfaces.

The second method suggested by Vertesi utilizes an unbalanced lubrication system to effect the desired uniform rate of heat removal from the various surfaces of the casting. Lubricant is introduced into the bottom of the mold at a higher pressure than lubricant introduced into the top of the mold. Vertesi suggests that this will tend to center the casting or ingot and the more uniform heat transfer effect will result. Vertesi makes no disclosure as to how he would sense uneven heat loss during casting.

A computerized approach for operating a continuous casting system is disclosed in U.S. Pat. No. 3,614,978 to Kosco. In this approach, heat transfer in various zones and casting position after casting emergence from the mold are monitored.

In casting, it is highly desirable that the cast product be free of unwanted distortions. Where straightness or a specific curvature of the cast product is a primary concern, systems which utilize a heat loss type of approach do not recognize that there may also be non-thermal reasons, i.e. misalignment between the casting support mechanism and the mold, for distortion. By sensing an indirect variable such as heat loss, response time is slowed while the operator interprets the meaning of the sensed heat loss. In situations where only small amounts of heat are removed through the mold wall, sensing heat loss may not be appropriate since it could lead to decreased sensitivity. Furthermore, the corrective action taken by the operator may or may not correct the distortion problem.

The present invention comprises an improved apparatus and process for maintaining a casting or ingot within a mold so as to substantially avoid unwanted distortions and uneven heat transfer problems. The apparatus and process of the instant invention is applicable to horizontal or vertical, continuous or semi-continuous, metal or metal alloy casting systems. In a preferred embodiment, the apparatus and process of the instant invention are used in conjunction with a horizontal slurry casting system.

In accordance with the instant invention, casting or ingot position within a mold is maintained so that the casting or ingot outer periphery is substantially uniformly spaced from the mold inner wall. Non-thermal detecting means are provided to sense the location of the casting or ingot with respect to the mold inner wall. If it is sensed that the casting or ingot is out of alignment, a casting support means external to the mold is used to reposition the casting or ingot within the mold. By sensing the actual position of the casting or ingot within the mold, the operator is capable of promptly responding to those conditions which would ordinarily cause distortion of the casting or ingot.

Accordingly, it is an object of this invention to provide a process and apparatus for casting an ingot with substantially no unwanted distortions.

It is a further object of this invention to provide a process and apparatus as above having substantially uniform heat transfer about the ingot periphery.

These and other objects will become more apparent from the following description and drawings.

Embodiments of the casting process and apparatus according to this invention are shown in the drawings wherein like numberals depict like parts.

This invention is principally intended to provide a control system for the maintenance of casting or ingot position with respect to the mold during continuous or semi-continuous casting. By maintaining the casting or ingot in a desired position, unwanted distortions should be avoided and surface quality should be enhanced. A casting product having no unwanted distortions and improved surface quality is highly desirable from an economic standpoint since waste is reduced. It is also highly desirable from the standpoint that unwanted distortions which may cause excessive mold wear by creating uneven heat transfer about the product and by producing contact between the product and the mold may be avoided.

Figures 1, 3:
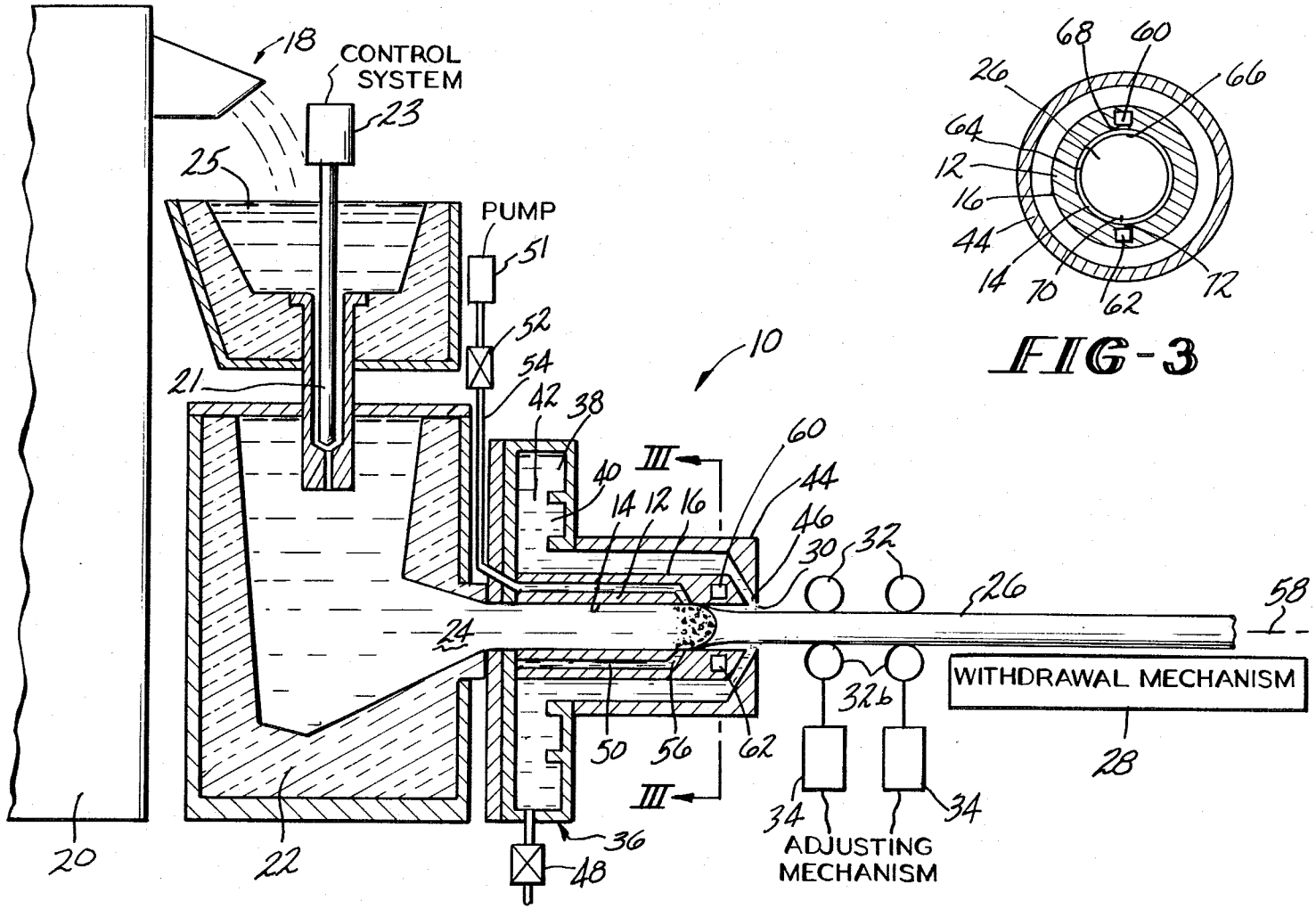
FIG. 1 is a schematic representation in partial cross section of an apparatus for casting in a horizontal direction incorporating the instant invention.
FIG. 3 is a cross section of the apparatus of FIG. 1 along the lines III—III in FIG. 1.

Referring now to FIGS. 1 and 3, an apparatus 10 for continuously or semi-continuously casting metal or metal alloys is shown. Molten material is supplied to a mold 12 adapted for such continuous or semi-continuous casting. Mold 12 may be formed in any suitable manner of any suitable material such as copper, copper alloy, aluminum, aluminum alloy, austenitic stainless steel or the like. The mold may have any desired cross-sectional shape. As shown in FIG. 3, mold 12 is preferably cylindrical in nature and has inner 14 and outer 16 walls.

The molten material is supplied to mold 12 through supply system 18. The molten material supply system comprises the partially shown furnace 20, valve 21, trough 25, tundish 22 and control system 23. Molten material may be supplied directly from furnace 20 into trough 25 having a downspout and valve 21. The molten material is then supplied to the tundish 22 through the downspout. Any suitable control system 23 may be provided to control the flow of molten material from furnace 20 into the tundish and to control the height of the molten material in the tundish. Alternatively, molten material may be supplied directly from the furnace into the trough.

The molten material exits from tundish 22 horizontally via conduit 24 which is in direct communication with the inlet to mold 12. Within mold 12, a solidifying casting or ingot 26 is formed. As used herein, the word ingot is intended to include a bar, a strand, a rod, a wire, a tube, etc. The solidifying ingot 26 is withdrawn from mold 12 by a withdrawal mechanism 28. The withdrawal mechanism 28 provides the drive to the casting or ingot 26 for withdrawing it from the mold section. The flow rate of molten material into mold 12 is controlled by the extraction of casting or ingot 26. Any suitable conventional arrangement may be utilized for withdrawal mechanism 28.

Adjacent the exit 30 of mold 12, a plurality of devices 32 are located to provide support to the ingot 26 as it is withdrawn from mold 12 and to position the solidifying ingot 26 within mold 12. In a preferred embodiment, the support devices 32 comprise a plurality of rollers spaced about the periphery of the ingot. When the ingot being produced has a circular cross section, it is preferred that the rollers be spaced at 120° angles about the periphery of the ingot. In lieu of rollers, support devices 32 may comprise any suitable rest or mechanical support device. It is also preferred that at least some, if not all, of the support devices 32 be adjustable. The support devices 32 may be provided with any suitable adjustment mechanism 34 such as a piston and cylinder arrangement, rack and pinion arrangement, etc. In the embodiment of FIG. 1, lower support mechanisms 32*b* are adjustable.

A cooling manifold 36 is arranged circumferentially around the outer mold wall 16. The particular manifold shown includes a first input chamber 38 and a second chamber 40 connected to the first input chamber by a narrow slot 42. A coolant jacket sleeve 44 formed from any suitable material is attached to the manifold 36. A discharge slot 46 is defined by the gap between the coolant jacket sleeve 44 and the outer mold wall 16. A uniform curtain of coolant, preferably water, is provided about the outer mold wall 16. The coolant serves to carry heat away from the molten metal via the inner mold wall 14. The coolant exits through slot 46 discharging directly against the solidifying ingot. A suitable valving arrangement 48 is provided to control the flow rate of the water or other coolant discharged in order to control the rate at which the metal or metal alloy solidifies. In the apparatus 10, a manually operated valve 48 is shown; however, if desired, this could be an electrically operated valve or any other suitable valve arrangement.

The molten metal or metal alloy which is poured into the mold 12 is cooled under controlled conditions by means of the water flowing over the outer mold wall 16 from the encompassing manifold 36. By the controlling of the rate of water flow along the mold wall 16, the rate of heat extraction from the molten metal within the mold 12 is partially controlled.

Mold 12 is also provided with a system for supplying lubricant to the inner mold wall 14. The lubricant helps prevent the metal or metal alloy from sticking to the mold and assists in the heat transfer process by filling the gaps formed between the mold and the solidifying ingot as a result of solidification shrinkage. The lubricant supply system comprises a passageway 50 within the mold 12 connected to a source of lubricant not shown by a pump 51, valving arrangement 52 and conduit 54. Valving arrangement 52 may comprise any suitable valving arrangement such as a manual valve, an electrically operated valve, etc. Passageway 50 is arranged circumferentially around the inner mold wall 14. The passageway 50 has discharge slot 56 which discharges the lubricant into the molten metal or metal alloy. The lubricant may comprise any suitable material and may be applied in any suitable form. In a preferred embodiment of the invention, the lubricant comprises rapeseed oil provided in fluid form. Alternatively, the lubricant may comprise powdered graphite, high-temperature silicone, castor oil, other vegetable and animal oils, esters, paraffins, other synthetic liquids or any other suitable lubricant typically utilized in the casting arts. Furthermore, if desired, the lubricant may be injected as a powder which melts as soon as it comes into contact with the molten metal.

Figure 2:
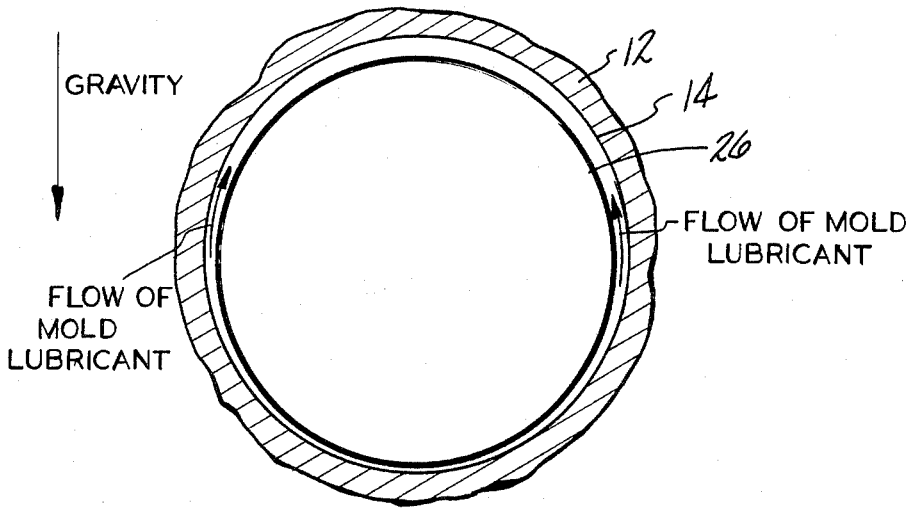
FIG. 2 is a cross-sectional view of a mold wherein the solidifying casting or ingot is out of alignment with the casting axis.
Figure 4:
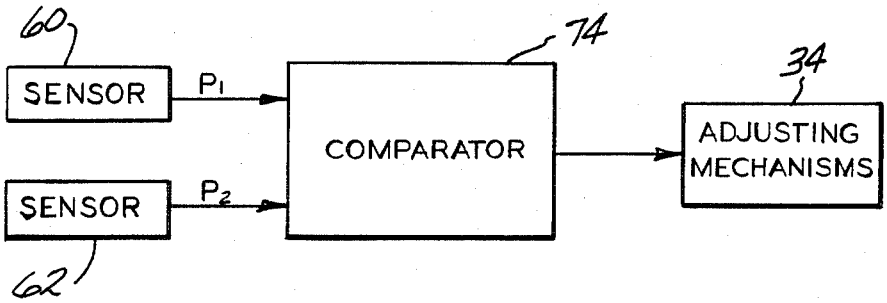
FIG. 4 is a schematic representation of a control system for operating the apparatus of FIG. 1 in accordance with the instant invention.

During horizontal casting, problems arise due to the adverse effect of non-uniform forces, primarily gravity, over the casting cross section. After solidification shrinkage, the solidifying casting or ingot 26 tends to sag towards the bottom of the casting mold. As a result, the heat transfer rate becomes non-uniform about the periphery of the casting. While the reason for the non-uniform heat transfer rates is not fully understood, it is believed to be in part due to the forcing of the lubricant as a vapor film to the top of the mold. This problem is shown in FIG. 2. The heat transfer at the top of the mold is believed to be greatly different from that at the bottom because of the different thicknesses of lubricant vapor film. This adverse effect leads to changes in surface quality as a result of sweating at the top ingot surface due to poor heat transfer and drag marks or longitudinal cracking of the bottom ingot surface. In addition to these surface defects, the tendency to sag can create unwanted distortions in the ingot by causing the ingot to exit misaligned with respect to the casting axis 58. Misalignment between the ingot and the support and withdrawal mechanisms can lead to periodic angle changes.

The instant invention substantially eliminates these problems by providing adjustable means for supporting the ingot adjacent the mold exit 30. These adjustable support means also function to position the solidifying ingot 26 within the mold 12 so that the outer periphery of the ingot is maintained substantially uniformly spaced from the inner mold wall 14. By using adjustable support means, the problems associated with support mechanisms that are aligned and fixed prior to casting are avoided.

To control the adjustable support means, the mold 12 is provided with non-thermal position detectors 60 and 62. The position detectors measure the distance between the outer ingot periphery 64 and the inner mold wall 14. Detector 60 measures the distance between a point 66 on the ingot periphery and a point 68 on the mold wall and generates a first signal $P_1$ representative of the measured distance. Detector 62 measures the distance between a point 70 on the ingot periphery and a point 72 on the mold wall and generates a second signal $P_2$ representative of the measured distance. In a preferred arrangement, detectors 60 and 62 are located on opposed sides of the casting periphery. As shown in FIGS. 1 and 3, detectors 60 and 62 are preferably located at the top and the bottom of mold 12. Alternatively, any suitable number of detectors and any suitable arrangement of the detectors may be used.

Detectors 60 and 62 may comprise any suitable non-thermal detecting means such as an indirect-inductive sensor, a capactive sensor, optical detector, ultrasonic detector, etc. The first signal $P_1$ from detector 60 and the second signal $P_2$ from detector 62 are fed to a comparator 74. If $P_1$ is different from $P_2$, a signal is sent to the adjusting mechanisms 34 to adjust the position of the ingot 26 within the mold 12 by adjusting the support devices 32*b*. When the ingot 26 has been moved so that $P_1$ equals $P_2$, the ingot 26 is in the proper position and no further adjustment is required. Comparator 74 may comprise any conventional comparator known in the art.

Figure 5:
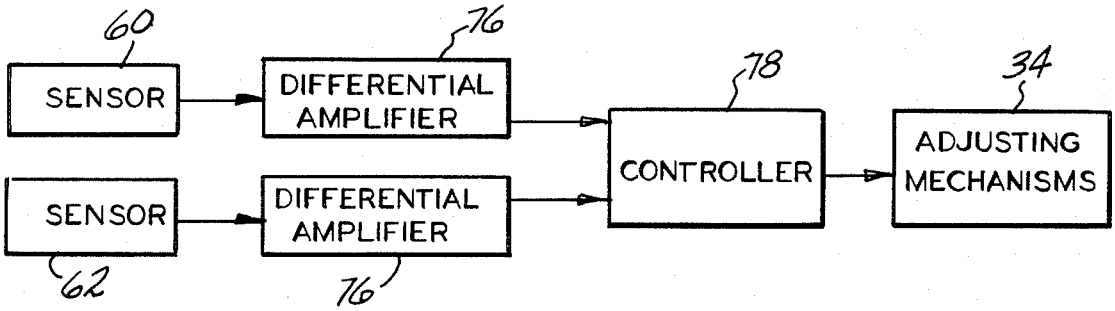
FIG. 5 is a schematic representation of an alternative embodiment of a control system for operating the apparatus of FIG. 1 in accordance with the instant invention.

Alternatively, detectors 60 and 62 may comprise two multi-turn coils each having a few hundred turns wound on a ferrite core. The two multi-turn coils can be series connected and serve as the inductive element in a parallel LC resonant circuit not shown. The inductance L and the capacitance C should be selected so that the frequency of oscillation, preferably about 50 KHz, produces a magnetic field with a skin depth approximately twice as deep as the largest surface imperfection. The voltage across each inductor can then be sensed using differential amplifiers 76 as shown in FIG. 5. The voltage drop across one of the inductive detectors can serve as the set point and the other as the feedback signal for a controller 78. The controller 78 may comprise a proportional integral derivative (PID) controller. A suitable PID controller is one made by Honeywell and sold under the trademark DIALATROL. In lieu of a PID controller, a balancing amplifier may be used for controller 78. The output of the controller would then drive adjusting mechanisms 34 to operate the support devices until the voltage drops across the inductors are equal. When the voltage drops across the inductor are equal, the ingot 26 is at its desired position within mold 12. With this type of arrangement, the smaller the sensor to ingot distance, the lower the voltage. Excellent system sensitivity, of the order of 0.1% to 1% of the sensor to ingot distance, should be obtainable in this manner.

In the instant invention, it is desirable that the detectors 60 and 62 be mounted within the mold thickness and be positioned at or near the mold exit 30. By mounting the detectors 60 and 62 within the mold itself, the detectors are rigidly coupled to the casting mold so that changes in mold dimensions, as a result of varying thermal conditions presented by casting speed and incoming metal temperature changes, do not affect the measurements. Likewise, the measurements are not affected by casting speed changes and varying metal temperature changes which affect cast bar size. Alternatively, detectors 60 and 62 may be mounted on either the inner 14 or outer 16 mold walls.

By sensing actual ingot position within the mold, a prompter response to the tendency of the ingot to sag can be effected. As a result, unwanted distortions of the ingot should be avoided and uniform heat transfer about the ingot periphery should be substantially maintained. There should also be substantially no misalignment relative to the casting axis. It should be noted that by using this type of arrangement, the initial alignment of the support mechanisms may be readily adjusted. Furthermore, ingot 26 should have improved surface quality since the likelihood of sweating at the top due to poor heat transfer and the likelihood of drag marks or longitudinal cracking at the bottom are decreased because concentricity between mold 12 and ingot 26 should be substantially maintained.

Figure 6:
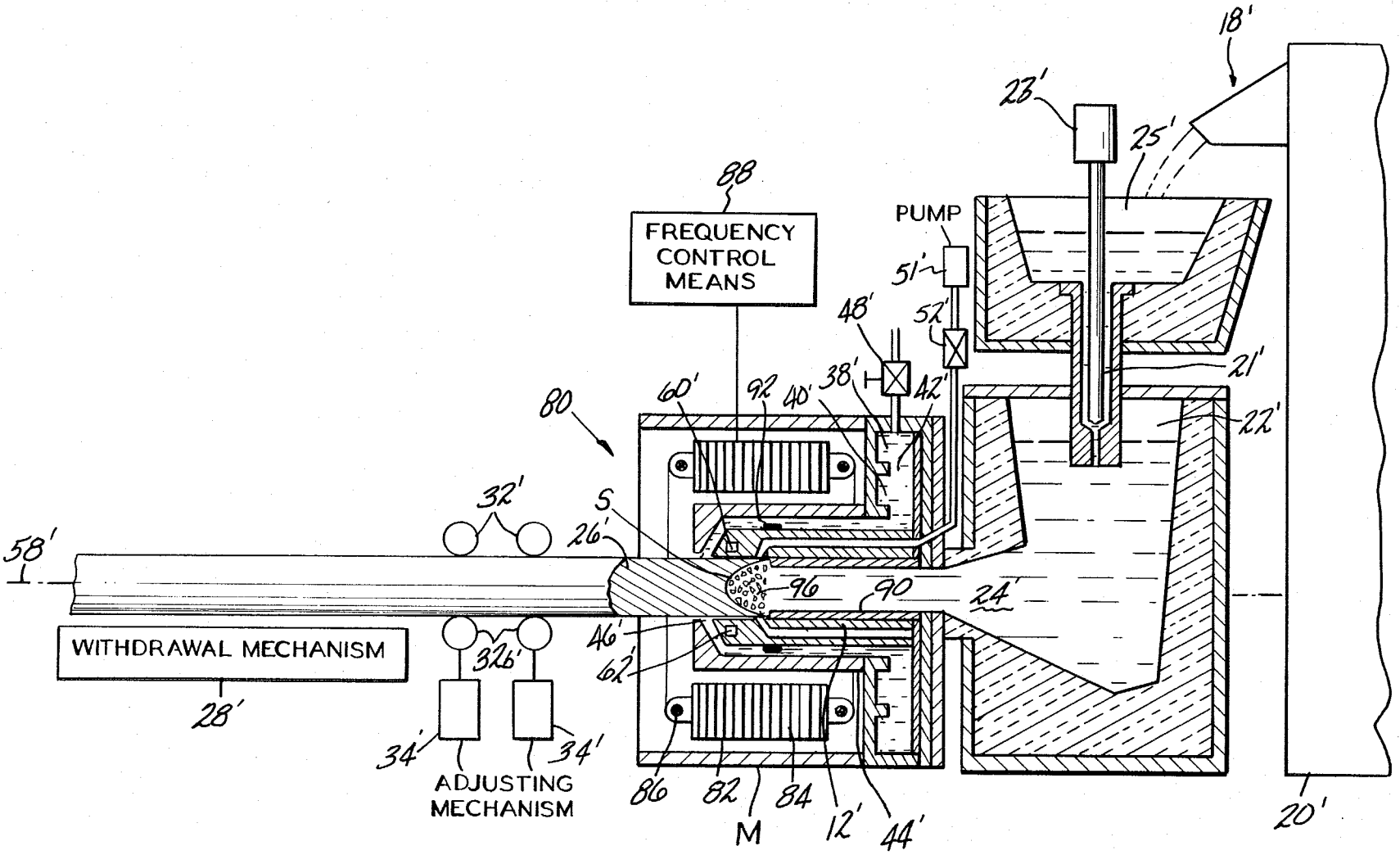
FIG. 6 is a schematic representation in partial cross section of an apparatus which incorporates the instant invention for casting a thixotropic semi-solid metal slurry in a horizontal direction.

The sensing and support arrangement of the instant invention is particularly adapted for use with the apparatus 80 shown in FIG. 6 for horizontally casting a thixotropic semi-solid metal slurry. The apparatus 80 of FIG. 6 is substantially that shown and described in U.S. patent application Ser. No. 289,572, filed Aug. 3, 1981 to J. A. Dantzig et al. (Attorney's Docket No. 11084-MB) for a MOLD FOR USE IN METAL OR METAL ALLOY CASTING SYSTEMS, which is hereby incorporated by reference.

The apparatus 80 of FIG. 6 is substantially the same as the apparatus 10 of FIG. 1. It differs from the apparatus 10 in that a magnetohydrodynamic stirring system is provided to stir the molten metal or metal alloy within the mold 12' to form a desired thixotropic slurry and in that the mold 12' has an insulating liner 90 adjacent the mold entry and an insulating band 92 mounted on the outer mold wall 16'. The magnetohydrodynamic stirring system comprises a two pole multi-phase induction motor stator 82 surrounding the mold 12'. The stator 82 is comprised of iron laminations 84 about which the desired windings 86 are arranged in a conventional manner to preferably provide a three-phase induction motor stator. The motor stator 82 is mounted within a motor housing M. Although any suitable means for providing power and current at different frequencies and magnitudes may be used, power and current are preferably supplied to stator 82 by variable frequency generator 88.

It is preferred to utilize a two pole three-phase induction motor stator 82. One advantage of the two pole motor stator 82 is that there is a non-zero field across the entire cross section of the mold 12'. Therefore, it is possible to solidify a casting having a desired slurry cast structure over its full cross section.

The insulating liner 90 and insulating band 92 are provided to postpone and control the initial solidification of the molten metal until the molten metal is in the region of a strong magnetic stirring force. As a result, the slurry cast ingot 26' should have a degenerate dendritic structure throughout its cross section even up to its outer periphery.

The mold 12' of the apparatus 80 has been modified to incorporate detectors 60' and 62' in the manner discussed previously. Apparatus 80 has also been provided with support devices 32' and **32*b'* and adjusting mechanisms 34'. The adjusting mechanisms and support devices are operated by the detectors 60' and 62'** in the manner described hereinbefore.

The magnetic stirring force generated by the magnetic field created by stator 82 extends generally tangentially of inner mold wall 14'. This sets up within the mold cavity 96 a rotation of the molten metal which generates a desired shear for producing the thixotropic slurry S. The magnetic stirring force vector is normal to the heat extraction direction and is, therefore, normal to the direction of dendrite growth. By obtaining a desired average shear rate over the solidification range, i.e., from the center of the slurry to the inner mold wall 14', improved shearing of the dendrites as they grow may be obtained.

To form a slurry casting or ingot 26' utilizing the apparatus 80, molten metal is poured into mold cavity 96 while motor stator 82 is energized by a suitable three-phase AC current of a desired magnitude and frequency. After the molten metal is poured into the mold cavity, it is stirred continuously by the rotating magnetic field produced by stator 82. Solidification begins from the mold wall 14'. The highest shear rates are generated at the stationary mold wall 14' or at the advancing solidification front. By properly controlling the rate of solidification by any desired means as are known in the prior art, the desired thixotropic slurry S is formed in the mold cavity 96. As a solidifying shell is formed on the ingot 26', the withdrawal mechanism 28' is operated to withdraw ingot 26' at a desired casting rate. Detectors 60' and 62' sense the position of ingot 26' within the mold 12' and operate adjusting mechanisms 34' to position support means 32' and **32*b'* so that concentricity of the ingot 26' and mold 12'** are maintained.

As used herein, the term slurry casting refers to the formation of a semi-solid thixotropic metal slurry directly into a desired structure such as a billet for later processing or a die casting formed from the slurry.

While the instant invention has been shown in conjunction with horizontal casting systems, it may also be used as part of a vertical casting system where it is desired that substantially uniform heat transfer about the casting periphery occur and that casting straightness be enhanced.

Solidification zone as the term is used in this application refers to the zone of molten metal or slurry in the mold where solidification is taking place.

Magnetohydrodynamic as the term is used herein refers to the process of stirring molten metal or slurry using a moving or rotating magnetic field. The magnetic stirring force may be more appropriately referred to as a magnetomotive stirring force which is provided by the moving or rotating magnetic field of this invention.

The process and apparatus of this invention are applicable to the full range of materials as set forth in the prior casting art including, but not limited to, aluminum and its alloys, copper and its alloys, and steel and its alloys.

The patents and patent application set forth in this specification are intended to be incorporated by reference herein.

It is apparent that there has been provided in accordance with this invention a cast ingot position control process and apparatus which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. An apparatus for casting molten metal comprising:

a mold surrounding said molten metal to effect heat transfer and thereby form a casting having an outer periphery;

said mold having inner and outer walls, a thickness defined by said inner and outer walls, and an exit through which said casting passes; and means for maintaining said casting within said mold so that said casting outer periphery is substantially uniformly spaced from said inner wall, said maintaining means comprising:

means for supporting said casting adjacent said mold exit;

first non-thermal detecting means for measuring a first distance between a first point on said casting outer periphery and a first point on said inner wall of said mold and for generating a first signal indicative of said first sensed distance;

second non-thermal detecting means for measuring a second distance between a second point on said casting outer periphery and a second point on said inner wall of said mold and for generating a second signal indicative of said second sensed distance area;

said first and second non-thermal detecting means being located adjacent the exit of said mold and within the mold wall;

means for comparing said first and second signals and for generating a control signal to operate said support means to position said casting so that said first and second distances are substantially equal, unwanted distortions of said casting are substantially avoided and substantially uniform heat transfer occurs about the casting periphery.

2. The apparatus of claim 1 further comprising:

said first non-thermal detecting means being located in a position opposed to the position of the second non-thermal detecting means.

3. The apparatus of claim 1 further comprising:

said mold having a longitudinal axis;

said casting having a longitudinal axis; and both said axes being oriented in a substantially horizontal direction.

4. The apparatus of claim 1 wherein said casting support means comprises:

means for contacting said casting periphery; and means for adjusting said contacting means, said adjusting means being responsive to said control signal.

5. The apparatus of claim 4 wherein said contacting means comprises: at least two rollers positioned about said casting periphery.

6. A process for casting molten metal comprising:

providing a mold having inner and outer walls, a thickness defined by said inner and outer walls, a longitudinal axis, and an exit;

surrounding said molten metal with said mold and forming a casting having an outer periphery by transferring heat away from said molten metal and through said mold;

passing said casting through said exit; and maintaining said casting within said mold so that said casting outer periphery is substantially uniformly spaced from said inner wall, said step of maintaining comprising:

providing means for supporting said casting adjacent said mold exit;

providing first and second non-thermal detecting means adjacent the exit of said mold and within the mold wall;

measuring a first distance between a first point on said casting outer periphery and a first point on said inner wall of said mold with said first non-thermal detecting means and generating a first signal indicative of said first sensed distance;

measuring a second distance between a second point on said casting outer periphery and a second point on said inner wall of said mold with said second non-thermal detecting means and generating a second signal indicative of said second sensed distance;

comparing said first and second signal and generating a control signal for operating said supporting means to position said casting so that said first and second distances are substantially equal, unwanted distortions of said casting are substantially avoided and substantially uniform heat transfer occurs about the casting periphery.

7. The process of claim 6 further comprising:

positioning said first non-thermal detecting means in a position opposed to the position of said second non-thermal detecting means.

8. The process of claim 6 further comprising:

said step of forming said casting comprising forming said casting with a longitudinal axis; and orienting said mold so that said mold longitudinal axis and said casting longitudinal axis both extend in a substantially horizontal direction.

9. The process of claim 6 further comprising:

said step of providing supporting means comprising providing means for contacting said casting periphery; and adjusting said contact means in response to said control signal.

* * * * *